US005772331A

United States Patent [19]

Irace et al.

[11] Patent Number: 5,772,331

[45] Date of Patent: Jun. 30, 1998

[54] OVEN OR MICROWAVE SAFE FREEZABLE PACKAGE WITH RECLOSURE

[75] Inventors: John J. Irace; Terry E. Maffit, both of St. Louis County, Mo.

[73] Assignee: Packaging Concepts, Inc., St. Louis, Mo.

[21] Appl. No.: 702,285

[22] Filed: Aug. 23, 1996

[51] Int. Cl.[6] ..... B65D 33/24

[52] U.S. Cl. ..... 383/90; 426/106; 426/107; 426/113

[58] Field of Search ..... 383/90, 89; 426/106, 426/107, 113

[56] References Cited

U.S. PATENT DOCUMENTS

| | | | |
|---|---|---|---|
| 599,219 | 2/1898 | Bunker | 383/90 |
| 1,128,192 | 2/1915 | Smith | 383/90 |
| 1,133,911 | 3/1915 | Barnard | 383/90 |
| 1,619,887 | 3/1927 | Sapp | 383/90 |
| 3,806,024 | 4/1974 | Marchesani | 383/90 |
| 4,008,851 | 2/1977 | Hirsch | 383/71 |
| 4,358,466 | 11/1982 | Stevenson et al. | 426/118 |
| 4,871,265 | 10/1989 | Peck | 383/89 |
| 4,902,141 | 2/1990 | Linnewiel | 383/89 |
| 4,911,563 | 3/1990 | Ciani | 383/89 |
| 5,044,776 | 9/1991 | Schramer et al. | 383/89 |
| 5,435,648 | 7/1995 | Berkoff | 383/90 |
| 5,582,889 | 12/1996 | Pedrini | 383/89 |

FOREIGN PATENT DOCUMENTS

| | | | |
|---|---|---|---|
| 677832 | 10/1995 | European Pat. Off. | 383/89 |

OTHER PUBLICATIONS

Packaging Review 1969, 89(4) 18 (Dialog Abstract).
Market Intelligence May 1993 22 pp. (Dialog Abstract).
Packag.Trends JPN No. 90–1, 5 Jan. 1990, p. 2 (Dialog Abstract).

*Primary Examiner*—Steven Weinstein
*Attorney, Agent, or Firm*—Paul M. Denk

[57] ABSTRACT

A microwave and oven safe packaging is provided which may be repeatedly resealed. The packing includes a top panel, a back panel, side panels and a bottom panel which define an enclosure in which a food item may be placed. The top and bottom panels have a top and a bottom, and the tops of the top and bottom panels are positionable substantially adjacent each other to define a top of the packaging. A non-metallic, flexible closure is provided which may be used to repeatedly close the package. The closure includes an elongate inner portion which extends generally parallel to the sides of the package. The inner portion is adhered to the bag front panel and is spaced from the top of the panel. An upper portion has a free and a fixed end. The upper portion is adhered to the bottom of the inner portion at its fixed end. The upper portion is longer than the inner portion and its free end extends beyond the top of the package to be wrapped about the top of the package and adhered to the back panel of the packaging. The free end of the closure upper portion is provided with adhesive applied to its inner surface. The adhesive is made of a material which may be repeatedly adhered to and removed from the package back panel. In an alternative, a single elongated portion forms the entire enclosure to secure the packaging in closure. The packaging preferably includes a heat resistant film, such as a polyester or polyethylene film. Preferably, the packaging is treated with a grease and/or oil treatment to prevent grease and oils from seeping or leaking through the bag. The grease and oil treatments include fluorocarbons and related polymers which are added to the pulp from which the paper package is made.

3 Claims, 1 Drawing Sheet

OVEN OR MICROWAVE SAFE FREEZABLE PACKAGE WITH RECLOSURE

BACKGROUND OF THE APPLICATION

This invention relates to a packaging which may be used for heating foods in either a microwave or oven, and in particular to a closure for the packaging which allows for reclosing of the package after it has been opened.

Currently, there are a variety of packages of the flexible and rigid type in which consumers can take home precooked or frozen foods. These currently available flexible packages do not have a closure, or have a closure which is not microwave safe. Further, the packages are not completely leak or grease proof, nor are they both oven and microwave safe.

Packages that have a reclosure device typically have a so-called "tin-tie" type closure. Such a closure includes a thin metal wire, or a metal strip, which allows for a dead fold so that the closure remains where it is placed to hold the package closed. This type of closure can heat up and possibly burn a consumer when it is removed from either a microwave or oven. Further, the tin-tie can lead to arcing in a microwave causing a fire or damage to the food item and/or the microwave. The tin-tie closure can also heat up sufficiently to ignite a paper package or melt a plastic package.

Additionally, current packaging of take-out foods often allows liquids, oils, or grease to escape the packaging. This can damage, for example, a car seat, when the item is being carried home from a restaurant.

Further, many current flexible packaging cannot be placed in the freezer. Thus, the consumer must transfer the food from the packaging to a new container to place the food in the freezer.

SUMMARY OF THE INVENTION

One object of the present invention is to provide a flexible packaging for "take-home" or "carry-out" food items.

Another object is to provide such a packaging which may be used to reheat the food in both a microwave oven and a standard oven.

Another object is to provide a closure for such a packaging.

Another object is to provide such packaging which substantially prevents grease, liquid, and oil leaks.

A further object of this invention is to provide a type of package or bag, with reclosure, that is dual ovenable for reheating in both conventional and microwave ovens.

A further object of this invention is to provide an oil and grease resistant package, and which is also leak resistant during usage.

Yet another object of this invention is to provide a tape type of closure/reclosure that may be used upon packaging, and which is safe for application both in conventional and microwave ovens.

A further object of this invention is to provide a reclosure means that can be used upon a variety of bags, whether it be the square bottomed bag, or the pinch or tube style of bags, as currently in usage.

These and other objects will become apparent to those skilled in the art in light of the following disclosure and accompanying drawings.

In accordance with the invention, generally stated, a microwave and oven safe packaging is provided which may be repeatedly resealed. The packaging includes a top panel, a back panel, side panels and a bottom panel which define an enclosure in which a food item may be placed. The top and bottom panels have a top and a bottom, and the tops of the top and bottom panels are positionable substantially adjacent each other to define a top of the packaging, for example, be formed as a gussetted paper bag. A non-metallic, flexible closure is provided which may be used to repeatedly close the package. The closure is multilayer and includes an elongate inner portion which extends generally parallel to the sides of the package and an upper portion. The inner portion is adhered to the bag front or back panel and is spaced a fixed distance from the top of the panel. The upper portion has a free and a fixed end. The upper portion is adhered to the bottom of the inner portion at its fixed end. The upper portion is longer than the inner portion and can be lifted from the free end and wrapped over the folded down top of the package and adheres to the back or front panel of the packaging. The free end of the closure upper portion is provided with adhesive applied to its inner surface. The adhesive is made of a material which may be repeatedly adhered to and removed from the package back or front panel.

The packaging paper used for the bag is preferably treated with a grease and/or oil treatment to prevent grease and oil from seeping or leaking through the bag. The grease and oil treatment generally includes fluorocarbons and related polymers which can be added to the pulp used to produce the paper or as an off-line treatment to the paper from which the packaging is made. The packaging may also include a heat resistant film laminated or glued to the paper used in making the bag.

DESCRIPTION OF THE PREFERRED EMBODIMENT

Figure 1:
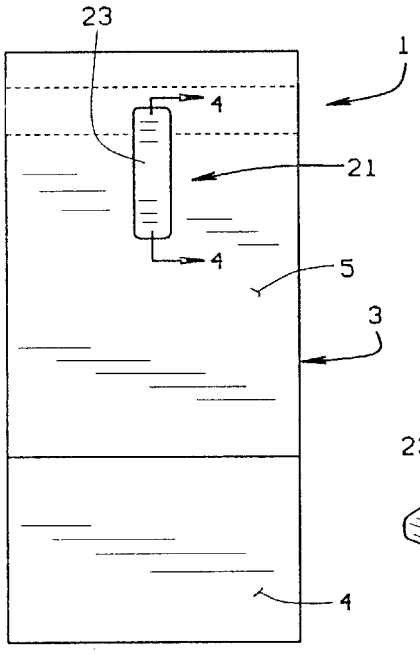
FIG. 1 is a plan view of a package of the present invention.
Figure 2:
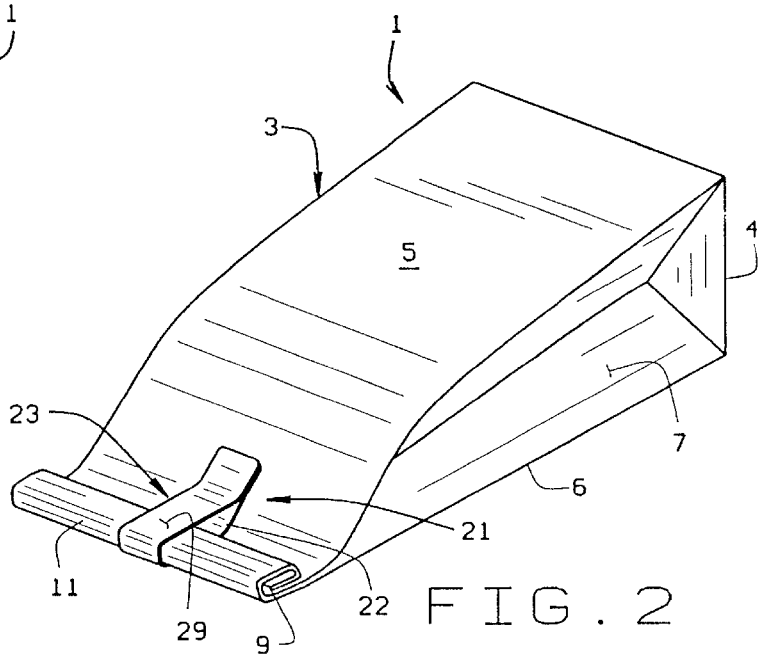
FIG. 2 is a perspective view of the package with a closure element closing the bag.

An illustrative embodiment of a package 1 of the present invention is shown in the FIGS. 1 through 4. The package 1 is shown as a gussetted bag 3 having a bottom 4, a front panel 5, a back panel 6, and gussetted side panels 7. The front and back panels are brought together and folded or rolled, as at 9, to form a closed top 11 of the bag 3. The front, back, sides and top cooperate to define an enclosure in which food can be stored. To prevent leakage, the sides and bottom of the bag 3 are sealed, the seals being of a material which is both microwave and oven safe. The bag 3 may be formed of paper, a heat resistant polymer film, such as polyester, polyethylene, or the like or may be formed of a combination of paper and such polymer films. Such a bag is described in U.S. Pat. No. 5,061,500, which is incorporated herein by reference, and which is owned by a common assignee. The bag could also be formed from one- or two-ply paper, similar to the same manner as microwave popcorn packages are formed.

The bag is preferably treated with grease and oil proofing treatments, such as are available from 3M under the name Scotch and product code FC807 or FX845, although other treatments may be available to provide these advantages for the paper bag. These treatments may be applied to the inside surface, outside surface, or both surfaces of the bag and prevent liquid, oils, and grease from leaking through or out of the bag. The pulp from which the paper bag is made can also be treated with fluorocarbons and related polymers to give the bag grease and oil resistant properties. Such bags are available from Rhinelander Corp. of Rhinelander, Wis., and International Paper Co. of Jay, Me., and other paper mills.

The bag 3 also includes a closure 21 which is free of metal. The closure is preferably an adhesive recloseable tab such as is available from Menasha Corp. of Neenah, Wis. The closure 21, shown more clearly in FIG. 4, includes an elongate inner portion 22 which is adhered to the bag front panel 5 spaced from the top of the panel and an upper or outer portion 23. The upper portion 23 may be the same length or longer than the inner portion 22, but of the same width as the inner portion 22. The upper portion is of a length such that it will lie flat along the front panel 5 when the top 11 of the package 1 is not formed, but is long enough to wrap over the top of the bag when the top 11 is formed. The outer portion 23 has a fixed end 25, a free end 27, and inner and outer surfaces 31 and 29, respectively. The fixed and free ends of the portion 23 both have a small patch of adhesive 33, 35 on the portion inner surface 29. The fixed end 25 of the upper portion is fixed to a bottom end of the inner portion 22. The adhesive patch 35 is a pressure sensitive adhesive, which is heat resistant, such that the free end may be initially removably adhered to the front panel 5 and then removably adhered to the back panel 6.

Figure 3:
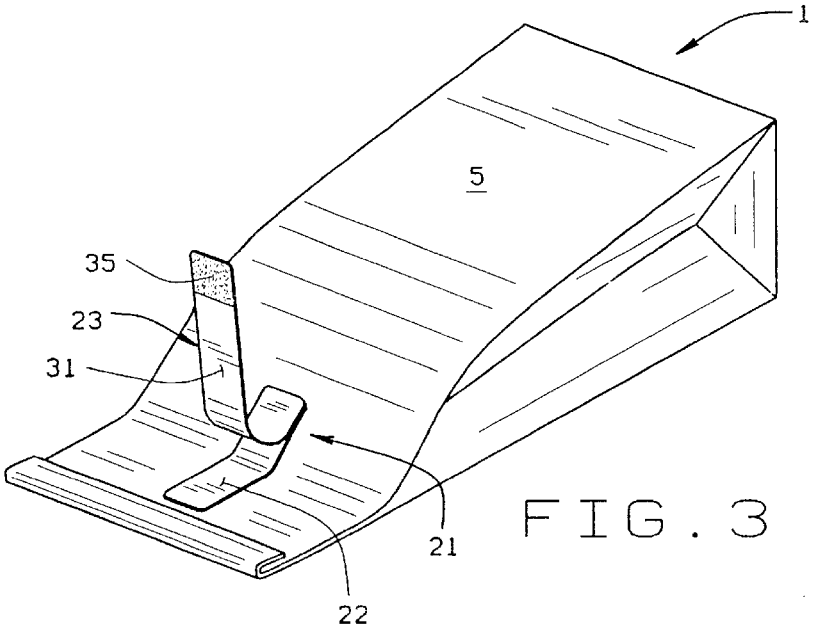
FIG. 3 is a perspective view of the package with the closure in an opened state to receive a folded top of the bag to close the bag.
Figure 4:
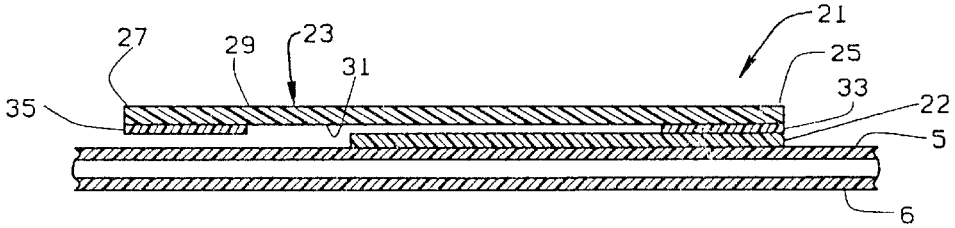
FIG. 4 is an enlarged cross-sectional view of the closure element taken along line 4—4 of FIG. 1.

A bag is received by the user, as shown in FIG. 1, with the free end 27 of the closure top portion 23 adhered to the front panel 5 of the bag 3 and without the top 11 of the bag formed. The front and back panels may thus be separated at their tops to insert a food item in to the bag. Once the bag is ready to be closed, the free end 27 of the closure upper portion is removed from the panel 5, as shown in FIG. 3, and, the top of the front and back panels are folded over, as at 9, to close the bag and form the top 11 of the bag. The free end 27 of the upper portion 23 is then wrapped around the top 11 of the fold over 9 and adhered to the surface of the back panel 6.

Although it is not necessary that the free end 27 be removably adherable to the back panel, this is preferred to allow the bag to be closed more than once.

In an alternative, the closure may be formed of a single strip of material, such as just the portion 23 alone, to seal and enclose the upper part of the bag into closure. The lower part of 23 will be permanently sealed to the bag panel.

As variations within the scope of the appended claims may be apparent to those skilled in the art, the foregoing description is set forth only for illustrative purpose and is not meant to be limiting. For example, although the package 1 was described with respect to a gussetted bag, the package could be another type of bag, such as a pouch-type bag, tubular bag, flat bottomed bag, or a paperboard box. If the packaging were used as a box, then the closure would be adhered to the front and top panels of the box. These examples are merely illustrative.

I claim:

1. A bag adapted to contain a food item and which is leak proof, resistant to grease and oil, and may be placed in an oven or microwave to reheat the food item when it is contained therein; the bag including an openable bag top, a front panel, a back panel, side panels and a closed bag bottom comprising a bottom panel, the front and back panels each having a top adjacent the bag top and a bottom adjacent the bag bottom, the tops of said front and back panels being adapted to be folded over each other to define a top closure for the bag, said panels defining an enclosure in which the food item is receivable; and a nonmetallic closure for maintaining the bag in a closed condition; the closure comprising:

an elongate inner portion which is adhered to the bag front panel and spaced from the top of the front panel, said inner portion having a bottom end and a top end that is closer to the top of the front panel than is the bottom end, said inner portion of said closure extending generally parallel to the side panels of said bag, and generally arranged, relative to the side panels, centrally of said front panel;

an elongate outer portion, which is longer than the inner portion, and which directly overlies both the inner portion of the closure and a part of said front panel beyond the extent of the inner portion of the closure, the outer portion having a fixed end, a free end, and inner and outer surfaces, said fixed end of said outer portion having adhesive on its inner surface such that the fixed end is permanently adhered to the said bottom end of said inner portion, said outer portion having a length sufficient for said outer portion free end to extend beyond the top end of said inner portion, and to extend beyond the top of said bag when the front and back panels are folded over each other, to provide for the outer portion free end to extend beyond the top of said bag and to wrap about the top of said bag and to be removably adhered to one of said panels of said bag; and adhesive applied to the inner surface of the outer portion at the free end of said outer portion, said adhesive being of a material which may be repeatedly adhered to and removed from said bag panels, said inner surface of said outer portion being devoid of adhesive between the adhesive applied to the inner surface of the outer portion at its free end and the adhesive applied to the fixed end of said outer portion where it attaches to the inner portion such that part of said outer portion that overlies the inner portion and part of the outer portion that directly overlies said portion of said front panel beyond the extent of the inner portion is devoid of adhesive, said adhesive applied to the inner surface of the outer portion at the free end being an adhesive formed of a material which may be repeatedly adhered to and removed from said bag panels;

said closure outer portion being of the same or lesser width than the closure inner portion, the closure outer portion being flexible;

said bag being resistant to leakage of grease, oil, and liquids, said bag comprising a heat resistant polymer film and/or paper, to provide a reopenable bag adapted to contain the food item.

2. The bag of claim 1 wherein the closure outer portion is of the same width as the closure inner portion.

3. The bag of claim 1 wherein the closure outer portion is of a lesser width than the closure inner portion.

* * * * *